US006177187B1

(12) United States Patent
Niemoller et al.

(10) Patent No.: US 6,177,187 B1
(45) Date of Patent: Jan. 23, 2001

(54) RECORDING MATERIAL FOR INKJET PRINTING

(75) Inventors: Axel Niemoller, Düren; Ralf Liebler, Kreuzau; Manfred Schäfer, Düren, all of (DE)

(73) Assignee: Sinhl GmbH, Duren (DE)

( * ) Notice: Under 35 U.S.C. 154(b), the term of this patent shall be extended for 0 days.

(21) Appl. No.: 08/886,701

(22) Filed: Jul. 1, 1997

(30) Foreign Application Priority Data

Jul. 13, 1996 (DE) ..... 196 28 341

(51) Int. Cl.[7] ..... B41M 5/00

(52) U.S. Cl. ..... 428/327; 428/195; 428/211; 428/304.4; 428/914

(58) Field of Search ..... 428/207, 211, 428/327, 914, 195, 198, 212, 201, 202, 343, 345, 347, 348, 352, 354, 304.4

(56) References Cited

U.S. PATENT DOCUMENTS

| | | | | |
|---|---|---|---|---|
| 4,257,934 | * | 3/1981 | O'Mahoney, Jr. | 260/27 BB |
| 5,194,317 | | 3/1993 | Sato et al. | 428/195 |
| 5,242,739 | | 9/1993 | Kronzer et al. | 428/200 |
| 5,260,159 | * | 11/1993 | Ohtani et al. | 430/106.6 |
| 5,501,192 | | 3/1996 | Kronzer | 428/323 |
| 5,501,902 | * | 3/1996 | Kronzer | 428/323 |
| 5,798,179 | * | 8/1998 | Kronzer | 428/411.1 |
| 5,851,651 | * | 12/1998 | Chao | 428/327 |

FOREIGN PATENT DOCUMENTS

| | | | | |
|---|---|---|---|---|
| 30 18342 A1 | | 11/1980 | (DE) . | |
| 195 38 675 A1 | | 5/1996 | (DE) . | |
| 0 227 245 A2 | | 7/1987 | (EP) . | |
| 0 575 644 A1 | | 12/1993 | (EP) . | |
| 0648611 A1 | * | 4/1995 | (EP) | B41M/5/00 |
| 0 648 611 B1 | | 4/1995 | (EP) . | |
| 62-242600 | | 10/1987 | (JP) . | |
| 1-157885 | | 6/1989 | (JP) . | |
| 1-182055 | | 7/1989 | (JP) . | |
| 7-47761 | | 2/1995 | (JP) . | |

OTHER PUBLICATIONS

Partial translation of JP A 62–242600

* cited by examiner

*Primary Examiner*—Bruce H. Hess
*Assistant Examiner*—Chris Cronin
(74) *Attorney, Agent, or Firm*—Baker & Daniels

(57) ABSTRACT

The present invention relates to a recording material for the inkjet method with aqueous inks, having at least one temporary substrate material and a porous ink absorption layer which is applied thereon, can be converted into a film and comprises from 60% by weight to 95% by weight of thermoplastic particles having a mean particle size between 1 $\mu$m and 40 $\mu$m, preferably from 5 to 20 $\mu$m, and 5–40% by weight of film-forming binder and, if required, conventional assistants and additives. After conversion of the recording layer into a self-supporting cohesive film by the action of heat and, if required, pressure, said film can be removed from the temporary substrate material at room temperature with a separation force of 10 cN/50 mm strip width to 800 cN/55 mm. In the case of further intermediate layers, the least adhesion of the laminated layers between one another in the laminate is that between temporary substrate material and adjacent layer.

After film formation, the recording material according to the invention is particularly suitable for outdoor applications but also for transfer printing, for example on textiles.

26 Claims, 1 Drawing Sheet

RECORDING MATERIAL FOR INKJET PRINTING

The invention relates to a recording material for inkjet printing, comprising at least one temporary sheet-like substrate material and a porous recording layer which is arranged thereon and can be converted into a film by the action of heat. After the production of recordings on the recording material by means of the inkjet printing method, it is possible to convert the recording layer into a film by the action of heat and to form a self-supporting film which can readily be detached from the temporary substrate at room temperature.

STATEMENT OF PRIOR ART

DE-A-30 18 342 describes a synthetic paper for inkjet printing, which is rendered transparent after printing in the inkjet printer by the action of heat in order to obtain multicolor inkjet recordings having high recording density, good color reproduction and high water resistance. It is only as a result of the subsequent melting that the print, which initially appears pale, acquires high contrast and becomes water-resistant. Papers of this type then have the disadvantage of low opacity (high transparency). The inventors are attempting to remedy this disadvantage by means of two- or three-ply papers having an opaque ply which cannot be rendered transparent and an outer ply or outer plies which can be rendered transparent and which consist of plastics. However, fiber-containing recording layers always give an inadequate printed image with respect to defined spot diameters and bleeding of the ink in the recording surface.

EP-A-0 575 644 describes a microporous coating by formation of an open-pore polymer matrix on exceeding the solubility limits of the chosen polymer in the solvent (mixture) or by sintering together individual polymer particles. This coating is also said to be printable by inkjet printing, it being possible to render the coating transparent after printing by means of heat, pressure or solvents and, in so doing, to encapsulate the ink dyes. The advantage is the increased durability of the prints after transparency has been imparted, in particular permanent resolution. The production of such layers is extremely difficult since precipitation reactions of polymers and sintering of polymers are difficult to control.

EP-B-0 227 245 describes an inkjet recording material having an outer, porous ink transport layer and an ink absorption layer arranged underneath and present on a preferably transparent substrate. During printing, the ink penetrates through the transport layer and is fixed in the absorption layer located underneath. In a particular embodiment, the ink transport layer can, after printing, be rendered transparent by heat and pressure in order to be able to view the image with high brilliance from the printed side, too. It is also possible to bond the melted transport layer to a substrate during the melting process in order to fix the image thereto. It is not intended here that the substrate of the coatings—a polyester film—can be peeled off. A disadvantage of this process is that the ink absorption layer contains water-soluble or swellable polymers which, under the influence of moisture, tend to destroy the adhesive bond and the printed image.

EP-A-648 611 discloses a three-layer inkjet recording material, comprising a temporary substrate with an ink receiving layer and a (hotmelt) adhesive layer applied thereon. After the unprinted recording material has been bonded to a given substrate, the temporary substrate, which may additionally carry a release layer, is peeled off and the ink absorption layer is free for printing. The disadvantage of this invention is the use of water-soluble ink absorption layers and the necessity of the expensive transfer prior to printing.

DE-A-19 53 8675 describes an overhead projector transparency having coatings which can be peeled off cohesively from the substrate after printing, in order to be reused or recycled.

U.S. Pat. No. 5,242,739 discloses a recording material whose recording layer can be applied in the molten state to other substrate materials. The recording layer contains a film-forming binder and thermoplastic polymer in particle form so that splitting of the layer during melt transfer may take place.

U.S. Pat. No. 5,194,317 describes a recording material for inkjet methods, whose recording layer contains a film-forming binder and plastics pigment, preferably polystyrene beads.

According to the teaching in EP-A-575 644, a recording layer for inkjet methods, which comprises a filler-rich polymer matrix having pores or capillaries perpendicular to the surface, is formed on a substrate.

In recent years, inkjet printing has become widely used. These printers, which in general are also capable of color printing, are used in particular in business sectors but also in the private sector. A further field of use involves large-area prints which can be produced using broad inkjet printers. These are used, for example, in advertising, in trade fair construction, as a substitute for large photographs, etc. Conventional inkjet recording materials therefore comprise a substrate which carries a special coating in order to absorb the generally aqueous inks rapidly and to give a crisp and brilliant image.

For outdoor applications exposed continuously to water, humidity and light, conventional, coated recording materials are not suitable for inkjet printing since the printed images applied are unstable to the stated environmental influences. The fixatives required for fixing the frequently used soluble anionic ink dyes do improve the water resistance in the case of porous coatings, for example those based on $SiO_2$, but they generally reduce the light stability and oxidation stability of the recordings. Glossy film and paper coatings comprise water-soluble or water-swellable coatings, some of which are also crosslinked, but which remain extremely water-sensitive after printing and are thus unsuitable for unprotected outdoor use.

To apply protection from environmental influences, it is usual to apply laminated films at high or low temperatures over the recording or to overcoat said recording. Both methods are expensive and require materials tailored to one another in order to achieve optimum effects. Inkjet prints treated by these methods also remain sensitive to water in the case of water-soluble or water-swellable coatings, at least from the edge, unless the edge is specifically sealed. Although the light stability can be increased by overlamination or overcoating, it remains limited since, for example, the cationic polymers used for fixing have an adverse effect in the ink recording layer. In the case of pigmented inkjet inks, the finely divided colored pigments (particle size <0.2 $\mu$m) are generally substantially more light stable but, owing to the low binder content in the inks, the pigment particles cannot be fixed in a truly water- and abrasion-resistant manner. A protective covering is therefore required even when these inks are used for prints intended for outdoors.

Owing to the disadvantages described, it has to date been possible to use conventional inkjet prints outdoors only to a very limited extent. However, conventional printing methods, such as screen printing, are economical only above a certain print run, so that there is a considerable demand for inkjet prints, especially with short print runs for outdoor use.

It is the object of the present invention to provide a recording material for inkjet printing with aqueous inks, which material meets all requirements for outdoor use and recordings of any type produced thereon withstand the influence of humidity or water, light and oxidation for a sufficient time.

SUMMARY OF THE INVENTION

This object is achieved by a recording material for the inkjet method with aqueous inks, containing at least one sheet-like temporary substrate material for an ink absorption layer, selected from paper impregnated and/or coated with silicones, paper impregnated and/or coated with chromium compounds as release agents, a plastics film coated with silicones, paper coated with silicone-free, synthetic polymers, a film of silicone-free polymers or a film provided with a release layer, and a porous ink absorption layer which is arranged on that surface of the substrate material which has the release property and comprises 60–95% by weight of fine thermoplastic polymer particles having a mean particle size of from 0.5 μm to 40 μm, preferably from 5 μm to 20 μm, and from 5 to 40% by weight of film-forming binder and, if required, further inorganic pigments/fillers and assistants and additives customary in ink absorption layers, and the ink absorption layer can be converted by the action of heat into a cohesive self-supporting film of fused or sintered plastics particles, the self-supporting film formed by the heat treatment being detachable at room temperature from the temporary substrate material with a separation force of from 0.1 N/50 mm to 8.0 N/50 mm sample width.

The invention also includes a process for the production of water-resistant and light-stable recordings on a recording material by applying aqueous ink(s) by means of inkjet methods to the ink recording layer of the recording material according to the invention, as described in general and also in more detail below. The ink absorption layer provided with the recording is subjected to heat and, if required, pressure, and the porous ink absorption layer is converted into a cohesive self-supporting film of fused or sintered plastics particles. The self-supporting film can be removed from the temporary substrate material at room temperature.

The separation force at room temperature is preferably from 0.1 N/50 mm to 4.0 N/50 mm, very particularly preferably from 0.1 N/50 mm to 2.0 N/50 mm sample width.

DETAILED DESCRIPTION OF THE INVENTION

In one embodiment of the invention, the recording material for the inkjet method with aqueous inks contains a sheet-like temporary substrate material selected from paper impregnated and/or coated with silicones, paper impregnated and/or coated with chromium compounds as release agents, a plastics film coated with silicones, paper coated with silicone-free, synthetic polymers, a film of silicone-free polymers or a film provided with a release layer, and a contact adhesive layer on that surface of the temporary substrate material which has the release property and, on said contact adhesive layer, a porous ink absorption layer which comprises 60–95% by weight of fine thermoplastic particles having a mean particle size of from 0.5 μm to 40 μm, preferably from 5 μm to 20 μm, and 5–40% by weight of film-forming binder and, if required, further inorganic pigments/fillers and assistants and additives customary in ink absorption layers.

The ink absorption layer can be converted by the action of heat into a cohesive self-supporting film comprising plastics particles fused or sintered together. The adhesion between the temporary substrate material and the contact adhesive layer is less than the adhesion between contact adhesive and ink absorption layer in the form of a film, so that the temporary substrate material can be detached from the contact adhesive layer at room temperature. Detachment of the temporary substrate material results in a film having a contact adhesive coating which can be attached to other absorption surfaces by means of the contact adhesive.

The laminate comprising temporary substrate material, contact adhesive layer and porous ink absorption layer may additionally have a plastics film arranged there between the ink absorption layer and the contact adhesive layer. As a result of the action of heat and, if required, the action of pressure to form a film from the porous ink absorption layer and to convert the latter into a self-supporting cohesive film, the resulting film is simultaneously firmly bonded to the plastics film. The least adhesion of the layers of the laminate to one another is that between the temporary substrate material and the contact adhesive, so that the laminate can be separated at room temperature without destruction of the layers only at the contact adhesive/temporary substrate material interface. The strength of the film formed on the ink recording layer is improved by the plastics film bonded therewith.

The separation force between temporary substrate material and contact adhesive layer in this embodiment is in the region of that of the conventional covering of contact adhesives with cover papers prior to their use, for example in the range from 0.1 N/50 mm to 2.0 N/50 mm sample width.

To facilitate the detachment of the temporary substrate material from the ink absorption layer in the form of a film or from the contact adhesive, the contact surface of the temporary substrate material is provided with a conventional release agent. Suitable release agents are silicones or chromium compounds known for this purpose. Preferred temporary substrate materials are paper impregnated and/or coated with silicones or a plastics film coated with silicones.

The temporary substrate material can, however, also be a paper coated with silicone-free synthetic polymers or a film comprising silicone-free polymers.

Such suitable synthetic polymers are, for example, polyethylene, polypropylene, polyesters and copolymers thereof, as well as cellulose derivatives.

The formation of a thin coating facilitating parting on the surface of the temporary substrate is preferred when the porous ink absorption layer capable of being converted into a film is to be transferred directly to a surface on film formation by the action of heat and is to be attached to said surface.

In this embodiment of the invention, heat-resistant surfaces can be printed by the transfer process. These include, for example, metal surfaces, ceramic material, sufficiently heat-stable plastics and textiles comprising cotton.

The thin layer on the temporary substrate is formed in such a way that, after film formation, a parting joint is present which permits peeling from the transferred ink absorption layer in the form of a film with separation forces of 0.5 N/50 mm to 8.0 N/50 mm sample width. If the separation force is lower, there is a risk that the ink absorption layer may be damaged during the treatment and printing by partial delamination, even before film formation. At higher separation force, it is scarcely possible to remove the temporary substrate manually, even in the case of relatively small sizes.

The invention also includes a process for the production of water-resistant and light-stable recordings on a recording material by applying aqueous ink(s) by means of inkjet processes onto the ink absorption layer of the recording material according to the invention, as described above and in even more detail below. The ink absorption layer provided with a recording is subjected to heat and, if required, pressure, and the porous ink absorption layer is converted into a cohesive self-supporting film comprising fused or sintered plastics particles. The self-supporting film can be detached from the temporary substrate material at room temperature. In embodiments of the recording material according to the invention, having further intermediate layers, the laminate is separated at the contact surface of the temporary substrate material with the adjacent contact adhesive layer.

It has been found, surprisingly, that a recording material for inkjet printing is provided by using, as the ink recording layer on the temporary substrate material, porous layers capable of being converted into films, it being possible to produce on said recording material recordings which, after film formation, meet all requirements for outdoor use.

These include the light stability of the recordings, the water resistance, the mechanical strength of the printed self-supporting film, the flexibility of the self-supporting film for adhesive bonding to uneven surfaces, the easy detachability of the self-supporting film from the temporary substrate and the easy applicability by means of contact adhesives.

The fact that certain embodiments permit transfer printing is advantageous.

On conversion of the ink absorption layer into a cohesive self-supporting film, the dyes absorbed by the ink absorption layer during printing are included and enclosed in the film, so that they are protected from the direct influence of water and oxygen outdoors. This also leads to better light stability of the recordings. Owing to the high water resistance of the layer in the form of a film, it is possible to dispense with further protective layers, either laminating films or overcoatings, for protecting the recording.

The particular advantage of the recording material according to the invention is that brilliant high-contrast multicolor or single-color recordings of high resolution can be produced by means of inkjet printing, which recordings are suitable for outdoor use after conversion of the recording layer into a film.

A permanent substrate for the ink absorption layer can, but need not, be dispensed with since a cohesive stable self-supporting film is formed in the film formation process.

Furthermore, the self-supporting film provided with a recording can be detached from the temporary substrate with little force, which facilitates its transfer to other surfaces. In particular, the porous ink absorption layer can, on film formation, be transferred directly or subsequently to the desired final surface by the action of heat and, if required, the action of pressure and the temporary substrate can subsequently be detached.

FIG. 1 shows the porous ink recording layer (1), capable of being converted into a film, on a temporary substrate material (2) and the interface (3) at which the layers of the laminate can readily be separated after conversion of the ink absorption layer or recording layer (1) into a film.

FIG. 2 shows the porous recording layer (1), capable of being converted into a film, on a temporary substrate material (2) with an intermediate layer (4) which is applied for facilitating separation, and the interface (3) at which the layers can readily be separated after conversion of the recording layer (1) into a film.

FIG. 3 shows the porous recording layer (1), capable of being converted into a film, on a temporary substrate material (2) with an intermediate layer comprising contact adhesive (4) and the interface (3) at which the layers of the laminate can be readily separated from the temporary substrate (2) after conversion of the recording layer (1) into a film.

Figure 1:
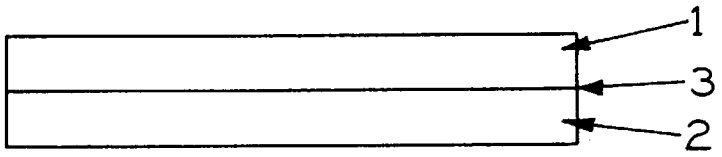
FIGS. 1 to 4 illustrate the embodiments of the recording materials according to the invention.
Figure 2:
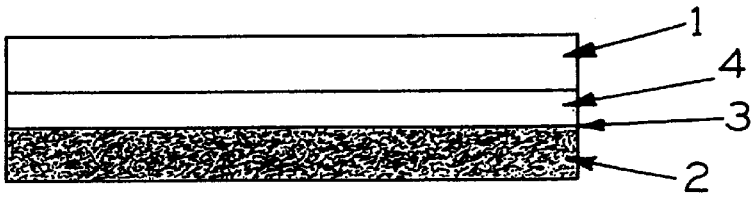
Figure 3:
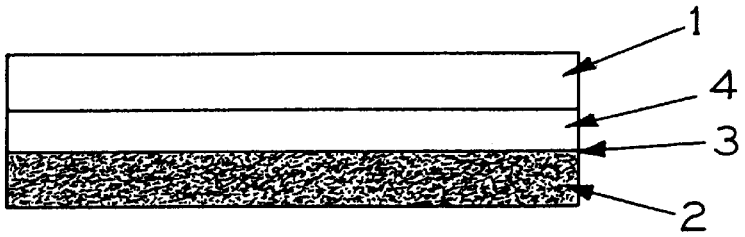
Figure 4:
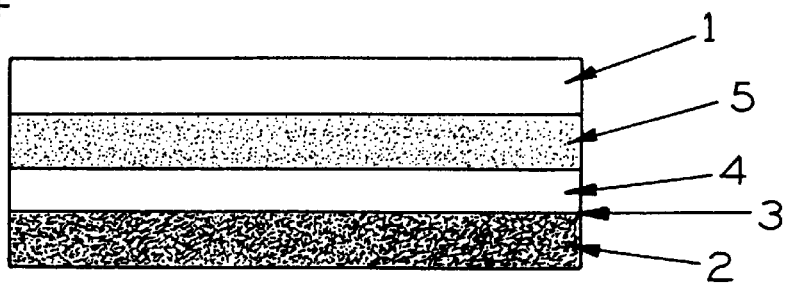

FIG. 4 shows the porous recording layer (1), capable of being converted into a film, on a temporary substrate material (2) with an intermediate layer comprising contact adhesive (4) and a further intermediate layer comprising a plastics film (5) and the interface (3) at which the layers of the laminate can be separated from the temporary substrate (2) after conversion of the recording layer (1) into a film.

Suitable temporary substrates (2) for the recording layer (1) are all sheet-like materials which permit the recording layer in the form of a film and possibly having further intermediate layers (3, 4, 5), to be removed at room temperature from the substrate material (2) with a separation force of between 0.1 N/50 mm and 4.0 N/50 mm strip width of the sample. In the case of an intermediate contact adhesive layer (5), for example, a siliconized paper or a siliconized film of polyethylene, polypropylene or polyester may be used.

The recording layer capable of being converted into a film may also be applied to a coated substrate paper (2), the coating of the temporary substrate material containing, for example, polyethylene, polypropylene, ethylene copolymer, for example with vinyl acetate, maleic anhydride, acrylic acid, cellulose derivatives, such as, for example, cellulose acetate, butyrate or propionate, or polyacrylate. Known substances, such as silicones, waxes, resins, amides, eg. erucamide, may be added as release agents.

Other suitable temporary substrates (2) are plastics films, for example comprising polyester, polyethylene, polypropylene, polycarbonate, polyimide, polymethyl methacrylate, polyamide, etc., which have little adhesion to the layer in the form of a film. This can also be achieved, in particular, if a thin release layer (4), for example comprising partially hydrolyzed polyvinyl alcohol, is applied between temporary substrate and layer capable of conversion into a film.

All commercial contact adhesive coatings may be used as contact adhesive layers (4). As a rule, the amount applied is between 10 $g/m^2$ and 30 $g/m^2$. Permanent or detachable adhesives based on, for example, acrylates, natural rubbers, silicones, ethylene vinyl acetate copolymers or thermoplastic elastomers may be used. These adhesives may contain tackifiers, waxes, oils and other assistants and are applied from the melt (hotmelt), from solvent or from aqueous dispersion by known methods to the temporary substrate material, as a rule a silicone paper or a siliconized film. If the recording layer (1) according to the invention is applied thereon, it is advantageous to carry this out in a second coating step directly thereafter without rolling up the contact adhesive beforehand. If this is not possible, adhesion must be prevented by means of a further release coating on the back of the temporary substrate (2). When a permanent substrate film (5) is used for the essentially self-supporting film, said substrate film is advantageously laminated with the contact adhesive layer. It is also possible to coat the permanent substrate film with contact adhesive, with or without prior application of porous recording layer (1) capable of being converted into a film, in which case the temporary substrate (2) is applied by lamination.

If the porous recording layer capable of being converted into a film is applied directly to the contact adhesive, in a preferred embodiment the contact adhesive is colored to prevent the background on which the printed image is applied after film formation from being visible through such contact adhesive. Conventional dyes and colored pigments are suitable for coloring. Whitening is particularly advantageous for obtaining optimum color representation of the prints. White pigments, such as titanium dioxide, calcium carbonate, hollow-particle pigments, kaolin, etc., may be used for this purpose.

Films of polyethylene terephthalate, PVC, PMMA, polyimide, polyethylene, polypropylene, polyamide and polycarbonate may be used as the permanent substrate film (6) for the recording layer. Films of soft PVC or polyolefins have proven particularly suitable for outdoor use. The films have a thickness between 20 $\mu$m and 200 $\mu$m and are very flexible.

Owing to the film-forming binder present, the porous ink absorption layer adheres well both to the temporary substrate material and to any intermediate layers present (contact adhesive layer or plastics film as permanent substrate) even before film formation and has sufficient cohesion to allow the recording material to be handled and printed on.

The conventional mechanical stress due to flexing, pleating, folding or rubbing of other materials on the surface, for example in the printing process, does not lead to damage to the ink absorption layer or to the printed image. The porous ink absorption layer (1) permits rapid ink absorption and fixation of the dyes contained in the printing ink.

To ensure good absorptivity for aqueous inks, a thermoplastic pigment which has a mean particle size of between 0.5 $\mu$m and 40 $\mu$m, preferably from 5 $\mu$m to 20 $\mu$m, is used in the recording layer (1). The usual polymer particles may be spherical; the pigment preferably has irregularly shaped particles. The softening point or melting point of the polymer used for the particles should be between 80° C. and 200° C., preferably between 100° C. and 160° C. If it is below this, the polymer also has, as a rule, a correspondingly low film formation temperature so that the formation of the porous ink absorption layer with polymer particles from a suspension/emulsion which have not yet fused with one another is not possible without melting and binding together the particles beforehand. If the melting point is higher, the heat treatment step to be carried out after printing is frequently not possible without decomposition of the recording layer or of the substrate material. The particle size distribution of the pigments may be broad or narrow; what is important with regard to the choice is sufficient ink absorptivity of the recording layer as a result of its porosity. Porous thermoplastic pigments having a high cavity volume, as may be obtained in the precipitation of polymers from solution, are particularly advantageous for this purpose.

So-called organic pigments comprising water-insoluble homopolymers or copolymers of the following classes of compounds may be used as polymers for the thermoplastic particles: polyacrylates, polymeth-acrylates, polyesters, polyamides, polyurethanes, polyethylene, polypropylene, polystyrene, polyvinyl acetate, polyvinyl chloride, polyvinylidene chloride, cellulose derivatives, starch derivatives and poly-epoxides.

Thermoplastic particles comprising polyamide or copolymers of polyamide, for example copolyamide 6 or copolyamide 12, are particularly preferred.

What is important with regard to the choice of a suitable finely divided thermoplastic organic pigment is the presence of defined particles having a predetermined size and shape, in order to obtain coatings which are as porous as possible for rapid ink absorption. It is advantageous to use particles as can be obtained, for example, on mechanical comminution, for example milling, of polymers, or as formed during the precipitation of polymers from solution. The recording layer should therefore have a porosity of at least 0.2 ml/g of dry coating material, which porosity is determined by the gravimetric absorption of water, and the mean particle size of the thermoplastic pigments should be between 0.5 and 40 $\mu$m, preferably between 5 $\mu$m and 20 $\mu$m, in order to ensure optimum drying during printing, crisp edges and high resolution. Recording layers having smaller pigment particles dry more poorly on application to substrate material, and layers having a mean particle size of more than 40 $\mu$m are rough and do not give images having crisp edges.

Mechanical properties of the thermoplastic pigments essentially determine the properties of the layer in the form of a film. A film formed from the thermoplastic organic pigment therefore preferably has an elongation at break of more than 5%, in particular more than 20%, and a tensile strength of more than 5 MPa (ISO R 527). A mechanically stable, flexible ink absorption layer is thus obtained on the substrate material after formation of a cohesive self-supporting film.

In order to obtain an abrasion-resistant coating, it is expedient to choose, for the thermoplastic pigment, a film-forming binder which, after drying of the generally aqueous coating compositions, binds the organic pigment particles to the substrate material and imparts sufficient cohesion to the layer without excessively reducing the porosity of the ink absorption layer. Plastics dispersions, such as, for example, vinyl acetate homo- or copolymers, acrylate (co)polymers, styrene/butadiene copolymers, ethylene or vinyl chloride copolymers and polyurethane dispersions have proven suitable for this purpose. In order to ensure the flexibility of the layer and the adhesion to the substrate or to the intermediate layer, dispersions having a minimum film formation temperature of between −20° C. and +50° C., preferably between −10° C. and +20° C., are preferably used. Furthermore, water-soluble binders, such as, for example, polyvinyl alcohol, polyvinylpyrrolidone, starch, starch derivatives, polyacrylamide, casein, water- or ammonia-soluble polyacrylates or polymeth-acrylates and copolymers thereof, for example with styrene, cellulose derivatives, such as cellulose ethers, carboxymethylcellulose and hydroxyethyl-cellulose, and gelatine may be used. In order further to increase the strength, crosslinking agents which react during drying of the layer may be incorporated into the coating composition. Suitable substances are to be found among the classes consisting of the urea/formaldehyde or melamine/formaldehyde resins, aziridines, polyfunctional isocyanates, boric acid (for PVA) and epoxy resins.

Optical brighteners, wetting agents, further inorganic pigments, for example silica, aluminum hydroxides or aluminas, kaolin, calcium carbonate or titanium dioxide, as well as dyes, adhesion promoters, antifoams, thickeners, dispersants, etc. may be present as further conventional assistants in the layer. In order to influence the melting point, the softening temperature and the flow behavior of the thermoplastic pigment, a plasticizer may furthermore be used. Suitable plasticizers are available for virtually all polymers, for example phthalates and fatty esters.

The use of assistants for fixing the anionic ink dyes in the recording layer is possible but not preferred. The cationic polymers usually used for fixing the anionic dyes, such as, for example, cationic acrylates, acrylamides, polydiallyldimethylamine chloride, polyallylamine, polydiallylamine, polyimine, etc., generally have an adverse effect on the lightfastness. The concomitant use of such compounds must therefore be checked with regard to their effects on lightfastness of the ink dyes and should as far as possible be avoided.

The ink absorption layer can be applied to the temporary substrate or the uppermost intermediate layer with the aid of conventional coating methods, for example by roller application or metering with an air brush or rotating doctor, preferably from aqueous dispersion, and dried with hot air. The applied amount of dried recording layer is between 10 and 50 g/m$^2$, preferably from 15 to 40 g/m$^2$. This applied amount is required, on the one hand, to ensure rapid absorption of the ink liquid in the recording layer during printing and hence to prevent bleeding of the image lines and, on the other hand, to permit the formation of a cohesive self-supporting film.

The weight per unit area of the recording layer may be varied as a function of the inkjet printer used for the recording layer and the amount of ink, in order to achieve optimum recording results.

The ink absorption layer adheres sufficiently to temporary substrate material but can be detached with the stated separation force after the formation of the cohesive film. It has good cohesion and flexibility so it withstands mechanical stresses. After film formation, the load-bearing capacity increases so that it is extremely difficult to damage mechanically both in the dry state and in the wet state.

The laminated recording material according to the invention has the least adhesion at the interface of the temporary substrate material with other laminate layers so that said substrate material can be readily removed after the recording layer has been subjected to a heat treatment.

The strong adhesion to any further intermediate layers present and the cohesion of the recording layer after film formation are advantageous in all outdoor applications but also in the transfer printing of surfaces, for example T-shirts. Particularly in textile printing, the self-supporting film bearing the printed image is, after film formation, resistant to stresses during washing, ironing and drying. Thus, repeated washes, for example 10 washes with commercial heavy-duty detergent, are possible without substantial losses of the strength, of the resolution and of the color contrast of the image applied to the textile.

After printing by means of inkjet printing, the inkjet recording material is brought to a temperature above the melting point or the softening point of the thermoplastic organic pigment used, the pore structure of the recording layer essentially being destroyed and a cohesive self-supporting film which encloses the assistants used and the ink dyes applied being formed. This aftertreatment of the ink absorption layer provided with a recording results in the ink dyes becoming insensitive to the effect of water. This applies both to water-soluble, anionic dyes used in conventional aqueous inkjet inks and to pigment colorants. Surprisingly, it was also found that the light stability of the heat-treated recordings increases to an extreme extent, particularly when soluble dyes are used. The formation of a plastics film from the layer containing the thermoplastic pigment can be accelerated and completed by the additional effect of pressure.

Suitable methods for the heat treatment are available, for example IR irradiation, hot pressing, ironing, heatable rollers or fixing means, as encountered in copiers or hot lamination apparatuses.

As a result of the conversion of the recording layer into a film, its surface becomes water-repellant and therefore cannot accept any further ink. This helps to achieve the high mechanical strength and high water resistance of the prints. Furthermore, it is generally unnecessary to apply a laminating film over the print for protection. This has enormous advantages in terms of process engineering and costs.

The recording material according to the invention can be printed on commercial inkjet printers with a high-contrast image which has crisp edges and high resolution, or with colored images of this type in the case of color printers. The porous recording layer capable of being converted into a film absorbs the generally aqueous ink and is dry and smudgeproof shortly after printing. Suitable printers are, for example, printers which operate according to the bubblejet principle, the piezoelectric principle or the continuous inkjet method, as offered in various forms, for example by Canon, Epson, Hewlett Packard, Lexmark, Sitex, Encad, etc. Both small-size (DIN A3 and A4) and large-size prints, for example on rolls for posters, advertising placards, are possible. Inks used in the abovementioned printers contain, as a rule, further assistants, such as, for example, high boilers (glycols, NMP, etc.) and wetting agents, in addition to water and anionic dyes.

After the heat treatment, the printed image is absolutely resistant to flexing, pleating, folding and scratching, both in the wet and in the dry state, so that the image information is retained without restriction for the desired time even under extreme environmental conditions. Inks which themselves have high light stability to UV light, too, are preferably chosen for image production. Owing to the fixing of the dyes and the water resistance of the coating itself, the material also withstands the prolonged action of water. The color intensity (contrast) of the printed image therefore decreases only slightly, if at all, in the course of storage for one week in water at 30° C. In any case, the color stability under these conditions is so good that, after this treatment, the optical density of colored surfaces of the primary colors black, cyan, magenta, yellow, blue, red and green is still at least 90%, based on the initial values.

As a result of the formation of the self-supporting film, the light stability of ink dyes enclosed therein increases. Particularly in the case of water-soluble dyes, an increase in the lightfastness by a factor of 2 or more is found, which can be calculated from the quotient of the exposure times to UV light until the time when a printed colored surface has only 90% of the optical density of the fresh print.

TEST METHODS

Test Print and Film Formation/Transfer:

A test image which contains in particular relatively large colored surfaces of primary colors (cyan, magenta, yellow and black) and of the binary mixed colors (blue, green, red) is applied to the recording material according to the invention by means of an inkjet printer. 10 minutes after production of the test image at the earliest, the recording layer is converted into a film in a plating press or by means of an iron. Advantageously, a release paper, for example having a silicone coating, is placed on the ink absorption layer capable of being converted into a film, in order to prevent adhesion to the press or to the iron. If the image is to be transferred, the print is produced laterally inverted and the recording material is placed with the recording layer on the desired surface to be provided with an image, and the recording layer is heated from the back of the recording material, through the temporary substrate material. The test printers used were the Stylus Color printers from Epson with original inks and Novajet III from Encad with commercial inks from American Inkjet Corp. On the basis of the test prints, the printed image is furthermore visually assessed with regard to its brilliance, color reproduction, edge crispness and resolution.

Water Resistance:

The printed recording material in the form of a film is stored for one week in water at 30° C. and then dried in a drying oven at 80° C. for 5 minutes. Thereafter, the optical density of each colored surface is determined by means of an RD 920 reflected light densitometer from Macbeth according to DIN 4512, as already carried out directly after conversion of the test print into a film. The percentage residual value of the optical density, calculated from the measurements before and after storage of the respective color area in water, is a measure of the change in the printed surface or of the fixing of the dyes of the inkjet inks. The colors black, red, green and blue were measured densitometrically without a filter, and the colors yellow, magenta and cyan with the appropriate filters.

UV Light Stability:

The light stability is determined by means of a UV accelerated weathering apparatus (Suntest from original Hanau Heraeus GmbH). Distance of the samples: about 230 mm, luminous intensity 150 klx, radiant flux density between 300 nm and 830 nm: 830 W/m$^2$. The surfaces of the four primary colors black, cyan, magenta and yellow described above are exposed for this purpose and regularly measured by means of the abovementioned densitometer with color filters. The plot of measured values as a function of the time then permits the evaluation of the color intensity under UV light, for example by extrapolating the time to the point at which the measured values decrease to 90% of the initial measured value.

Separation Force:

The separation force is determined by means of a tensile tester according to the Finat test method FTM 3 on 50 mm wide strips of the recording material after film formation. For this purpose, the sample is separated manually to such an extent that temporary substrate material and self-supporting film, if relevant with intermediate layers, can be clamped in the holders of the tensile tester and then pulled apart at 300 mm/min, the force for this purpose being registered.

EXAMPLE 1

A contact adhesive laminate comprising a 140 g/m$^2$ silicone paper as a temporary substrate material (kaolin-coated siliconized kraft paper), 20 g/m$^2$ of removable contact adhesive (Acronal 103L from BASF) and an 80 $\mu$m monomer-plasticized, white PVC film which is provided on the free surface with an adhesion promoter layer is coated with the following coating material in a coating weight (dry) of 40 g/m$^2$ by means of a rotating doctor and is dried in a drying oven at 100° C. for 5 minutes in order to form a porous recording layer capable of being converted into a film:

Water 40.0 g

Rhopaque HP91, styrene/acrylate hollow bodied dispersion (from Rohm & Haas), mean particle size 1.05 $\mu$m; 25% strength 85.0 g Polyvinyl alcohol Mowiol 4/88 (from Hoechst) 2.0 g Ammonia (25% strength) 1.5 g Polyethylene glycol, molar mass 400 g/mol 2.0 g Wetting agent Surfynol 440 (Air Products Inc.) 0.5 g The coating material has a solids content of about 19% by weight and a pH of 7.5. It contains 84%, based on the solid substance, of thermoplastic pigment.

The laminate thus produced is printed with a test image by means of a Novajet III inkjet printer from Encad using commercial ink cartridges from American Inkjet Corp. and the recording layer is converted into a film at 140° C. by means of a hot press in the course of 30 seconds. After this treatment, the now glossy recording enclosed in the layer is a high-contrast, high-resolution image having crisp edges. It has exceptionally high water resistance: the colored surfaces show only very little or no color changes relative to the initial color values as a result of the water treatment (Table 1).

The lightfastness of the printed areas is outstanding. After film formation, scarcely any change in a recording is detectable even after 200 hours of UV irradiation (Table 2).

The printed recording layer in the form of a film, together with the PVC film and the contact adhesive, can be removed from the temporary substrate with a slight force of 0.4 N/50 mm.

EXAMPLE 2

A contact adhesive laminate comprising a 140 g/m$^2$ silicone paper (kaolin-coated siliconized kraft paper), 20 g/m$^2$ of removable contact adhesive (Acronal 103L from BASF) and an 80 $\mu$m monomer-plasticized, white PVC film which is provided on the free surface with an adhesion promoter layer is coated with the coating material stated below in a coating weight (dry) of 30 g/m$^2$ by means of a rotating doctor on the adhesion promoter layer of the PVC film and is dried in a drying oven at 80° C. for 5 minutes in order to form a porous recording layer capable of being converted into a film:

Precipitated copolyamide (Orgasol 3502 D Nat 1, Elf Atochem) of melting point 140° C., mean particle size 20 $\mu$m 68.0 g Plastics dispersion of ethylene/vinyl acetate/copolymer (Vinnapas EP 400, Wacker Chemie GmbH) with minimum film formation temperature of 0° C. 18.4 g with mean particle size 0.8 $\mu$m Thickener polyacrylate (25% strength by weight) 4.0 g (Rohagit S vh, Röhm GmbH)

Ammonia (25% strength) 3.5 g

Plasticizer N-n-butylbenzenesulfonamide 7.0 g

Wetting agent Surfynol 440 (Air Products Inc.) 1.5 g

The coating material has a solids content of about 33% by weight and a pH of 8.5. It contains 78%, based on the solid substance, of thermoplastic pigment.

A test image is produced on the recording material thus prepared, by means of a Novajet III inkjet printer from Encad using commercial ink cartridges from American Inkjet Corp. and the recording layer is converted into a film at 160° C. by means of a hot press in the course of 1 minute. After this treatment, the test image now enclosed in the glossy layer is a high-contrast, high-resolution image having crisp edges. It has extremely high water resistance. The colored surfaces show only very little or no color changes relative to the initial color values as a result of the water treatment (Table 1). The UV stability of the colored surfaces is excellent. The printed image shows virtually no change even after more than 200 hours (Table 2).

The printed recording layer converted into a self-supporting film, together with the PVC film and the contact adhesive, can be removed with a slight force of 0.4 N/50 mm.

COMPARATIVE EXAMPLE 2

The contact adhesive laminate from Example 2 is coated and printed as described there. The printed image has crisp edges but little contrast. However, testing of the resistance to water and UV light is carried out without conversion into a film (without heat treatment). The water resistance of the prints (Table 1) is insufficient since the ink dyes are removed from the porous, printed layer to a considerable extent. Furthermore, the coating on the contact adhesive laminate in the wet state can be readily damaged mechanically so that the printed image is destroyed. The light stability is poor; under UV irradiation, the colors very rapidly become pale (Table 2).

EXAMPLE 3

A 140 g/m$^2$ silicone paper (kaolin-coated siliconized kraft paper) is first coated with 20 g/m$^2$ of permanently adhering contact adhesive (Acronal V205 dispersion from BASF), to which a wetting agent was added, and dried in a drying oven at 90° C. for 10 minutes. The following coating material is then applied to the contact adhesive layer in a coating weight (dry) of 30 g/m$^2$ by means of a rotating doctor and is dried in a drying oven at 80° C. for 5 minutes in order to obtain a porous recording layer capable of being converted into a film:

Water 80.0 g

Polyamide 11 powder, Rilsan D30 NAT from Elf Atochem 16.0 g
Mean particle size 30 $\mu$m Polyvinyl alcohol Mowiol 4/88 from Hoechst AG 2.6 g Cationic polymer, Additol VXT from Hoechst AG 0.8 g Diethanolamine 0.3 g Wetting agent (Surfynol 440, Air Products Inc.) 0.02 g The coating material has a solids content of about 20% by weight and a pH of 9.0. It contains 81%, based on the solid substance, of thermoplastic pigment.

A test image is produced on the recording material thus prepared, by means of a Novajet III inkjet printer from Encad using commercial ink cartridges from American Inkjet Corp. and the recording layer is converted into a film at 190° C. by means of a hot press in the course of 1 minute. After this treatment, the now glossy film shows a high-contrast, high-resolution image having crisp edges. It has extremely high water resistance: the colored surfaces show very little or no color changes relative to the initial color values as a result of the water treatment (Table 1). The UV stability of the colored surfaces is excellent. The printed image shows virtually no change even after 200 hours (Table 2).

The printed ink absorption layer converted into a self-supporting film, together with the contact adhesive, can be removed from the temporary substrate with a slight force of 0.5 N/50 mm. This transparent self-supporting film can be applied to another substrate, for example to glass or white surfaces, without further laminating film or substrate film.

EXAMPLE 4

Example 3 is repeated in all respects except that 15% by weight, based on dry weight, of titanium dioxide (Bayertitan RFD-1 from Bayer AG) are added to the contact adhesive. As a result of this, the self-supporting film is present on the white lower layer (contact adhesive) after transfer to another substrate surface. It can then be applied to colored substrates without the substrate being visible through it. The values of the water resistance, of the light stability and of the separation force do not change relative to Example 3.

EXAMPLE 5

A polyethylene-coated paper having a glossy surface and a basis weight of 130 g/m$^2$ is used. A thin film of the following coating composition is applied to this surface:

Partially hydrolyzed polyvinyl alcohol (20% strength in methanol) 40 g (Alcotex 359B from Harlow Chemicals) Methanol 60 g Precipitated silica (FK 320 from Degussa AG) 6 g After drying at 70° C. for 1 minute, the coating weight is about 1 g/m$^2$. The coating composition stated below is applied in a coating weight (dry) of 30 g/m$^2$ onto this layer by means of a rotating doctor and is dried for 5 minutes at 80° C. in order to form a porous recording layer capable of being converted into a film:

Precipitated copolyamide (Orgasol 3501, ExDNAT1, Elf Atochem) Mean particle size 10 $\mu$m 8.0 g Precipitated copolyamide (Orgasol 3502 DNAT1, Elf Atochem)

Mean particle size 20 $\mu$m 60.0 g Acrylate copolymer dispersion (47% solids content) (Carboset PL 958, B. F. Goodrich Co.) (Minimum film formation temperature <10° C.) 9.2 g Thickener (Sterocoll D, 25% strength dispersion) absolutely dry 1.0 g Ammonia (25% strength) 0.8 g Plasticizer, N-n-butylbenzenesulfonamide 5.1 g Wetting agent (Fluorad FC 170C) 1.5 g Wetting agent Surfynol 440 (Air Products Inc.) 0.1 g The recording material obtained is printed on a Stylus Color II inkjet printer from Epson using original inks, with lateral inversion. After a drying time of 15 minutes, the recording material is placed with the image side on a commercial T-shirt of pure cotton and the image is converted into a film at about 150° C. for about 1 minute by means of an iron from the back of the recording material and is thereby anchored to the textile material. After cooling of the laminate obtained, the polyethylene-coated paper, which served as the temporary substrate, can be removed. The separation force to be applied was 3.0 N/50 mm.

In order to test the water resistance of the printed image on the textile material, the T-shirt was washed 10 times in a commercial washing machine (Miele Novotronic W 718) at 40° C. in the heavy-duty wash program using heavy-duty detergent (Persil Megaperls® from Henkel) with subsequent spinning and was dried (in the air). After each wash cycle, the material was ironed at 180° C., the print being covered with an antiadhesion paper. Even after repeated washing and ironing, the image was essentially unchanged.

EXAMPLE 6

A kraft paper smooth on one side and having a basis weight of 100 g/m$^2$ is coated on the smooth side with a coating of the following composition in a coating weight of 3 g/m$^2$ (dry) by roller application and air brush metering and is dried for 1 minute at 80° C.

Methyl ethyl ketone 85 kg

Cellulose acetopropionate (CAP 482.05 Eastman Kodak) 8 kg

Dioctyl phthalate 1.5 kg

Calcium stearate 0.15 kg.

A porous ink absorption layer capable of being converted into a film is formed on this coating, as described in Example 3. In contrast, the layer weight is about 40 g/m$^2$.

The recording material obtained is printed on an Epson Stylus Color II inkjet printer using original inks from the equipment manufacturer, with lateral inversion. After a drying time of 15 minutes, the printed recording material is placed with the image side on a pure cotton fabric and the recording layer is converted into a film on a hot press at about 190° C. in the course of 1 minute and at the same time transferred to the fabric and anchored thereto. After cooling, the temporary substrate material can be readily removed. The separation force is 1.65 N/55 mm.

The resistance of the transfer print to washing is excellent. The image quality is virtually unchanged even after 10 wash cycles. The optical density according to DIN 4512 of color surfaces of the primary colors is still at least 90% of the initial values.

TABLE 1

| | Percentage residual value of the optical density after storage for one week in water at 30° C., in % | | | | | | |
|---|---|---|---|---|---|---|---|
| | Black | Cyan | Magenta | Yellow | Blue | Red | Green |
| Example | | | | | | | |
| 1 | 96 | 98 | 94 | 99 | 100 | 97 | 98 |
| 2 | 92 | 95 | 99 | 94 | 93 | 96 | 100 |
| 3 | 98 | 99 | 97 | 100 | 95 | 99 | 100 |
| Comparative Example 2 | 20 | 37 | 41 | 60 | 55 | 46 | 41 |

Light stability of the primary colors:

TABLE 2

| Light stability of the primary colors: | | | | |
|---|---|---|---|---|
| Time in | Optical density (Macbeth densitometer RD 920) | | | |
| Sun-Test | Black | Cyan | Magenta | Yellow |
| Example 1 | | | | |
| 0 hours | 1.53 | 1.36 | 1.21 | 1.06 |
| 72 hours | 1.54 | 1.33 | 1.18 | 1.06 |
| 144 hours | 1.52 | 1.3 | 1.12 | 1.05 |
| 216 hours | 1.48 | 1.29 | 1.1 | 1.03 |
| Example 2 | | | | |
| 0 hours | 1.57 | 1.54 | 1.53 | 1.43 |
| 72 hours | 1.53 | 1.54 | 1.51 | 1.42 |
| 144 hours | 1.45 | 1.48 | 1.42 | 1.41 |
| 216 hours | 1.43 | 1.43 | 1.31 | 1.41 |
| Example 3 | | | | |
| 0 hours | 1.60 | 1.28 | 1.32 | 1.25 |
| 72 hours | 1.58 | 1.26 | 1.30 | 1.22 |
| 144 hours | 1.53 | 1.23 | 1.30 | 1.20 |
| 216 hours | 1.54 | 1.19 | 1.27 | 1.15 |

TABLE 2-continued

| Light stability of the primary colors: | | | | |
|---|---|---|---|---|
| Time in | Optical density (Macbeth densitometer RD 920) | | | |
| Sun-Test | Black | Cyan | Magenta | Yellow |
| Comparative Example | | | | |
| 0 hours | 1.53 | 1.36 | 1.21 | 1.06 |
| 72 hours | 1.28 | 1.26 | 0.65 | 0.87 |
| 144 hours | 1.15 | 1.21 | 0.37 | 0.74 |
| 216 hours | 1.04 | 1.19 | 0.27 | 0.6 |

What is claimed is:

1. A recording material for recording aqueous inks, said recording material comprising:

(i) a temporary substrate, said temporary substrate selected from the group consisting of a) a paper impregnated with silicones, b) a paper coated with silicones, c) a paper impregnated with chromium compounds, d) a paper coated with chromium compounds, e) a plastics film coated with silicones, f) and a paper coated with silicone-free synthetic polymers, said silicone-free synthetic polymers selected from the group consisting of polyethylene, polypropylene, polyesters and copolymers thereof, and cellulose derivatives;

(ii) a contact adhesive layer arranged on said temporary substrate;

(iii) a porous ink absorption layer arranged on said contact adhesive layer, said porous ink absorption layer comprising from 5% to 40% by weight of film-forming binder, and from 60% to 95% by weight of fine thermoplastic particles having a mean particle size of from 0.5 $\mu$m to 40 $\mu$m;

said porous ink absorption layer convertible by heat into a cohesive self-supporting film of said thermoplastic particles fused together such that the adhesion of said contact adhesive layer to said temporary substrate is less than the adhesion of said contact adhesive layer to said self-supporting film, said temporary substrate material removable at room temperature from said contact adhesive layer and said self-supporting film with a separation force of from 0.10 N/50 mm to 2.0 N/50 mm sample width.

2. The recording material of claim 1, wherein the mean particle size of said fine thermoplastic particles is from 5 $\mu$m to 20 $\mu$m.

3. The recording material of claim 2, wherein said fine thermoplastic particles comprise at least one of polyethylene, polypropylene, polyester, polyamide, polyurethane, poly(meth)acrylic polymers, polystyrene, polyvinyl chloride, polyvinyl acetate, polyepoxide, and copolymers thereof.

4. The recording material of claim 3, wherein said fine thermoplastic particles are porous.

5. The recording material of claim 1, wherein said porous ink absorption layer has a basis weight of from 10 g/m$^2$ to 50 g/m$^2$.

6. The recording material of claim 1, wherein said porous ink absorption layer contains a plasticizer.

7. The recording material of claim 1, wherein said ink absorption layer forms the self-supporting film at from 80° C. to 200° C.

8. The recording material of claim 1, wherein said porous ink absorption layer further comprises at least one of an inorganic pigment, and inorganic filler, an assistant, and an additive.

9. A recording material for recording aqueous inks, said recording material comprising:

(i) a temporary substrate, said temporary substrate selected from the group consisting of a) a paper impregnated with silicones, b) a paper coated with silicones, c) a paper impregnated with chromium compounds, d) a paper coated with chromium compounds, e) a plastics film coated with silicones, f) and a paper coated with silicone-free synthetic polymers, said silicone-free synthetic polymers selected from the group consisting of polyethylene, polypropylene, polyesters and copolymers thereof, and cellulose derivatives;

(ii) a permanent substrate arranged on said temporary substrate, said permanent substrate comprising one of a thin coating and a plastics film;

(iii) a porous ink absorption layer arranged on said permanent substrate, said porous ink absorption layer comprising from 5% to 40% by weight of film-forming binder, and from 60% to 95% by weight of fine thermoplastic particles having a mean particle size of from 0.5 $\mu$m to 40 $\mu$m;

said porous ink absorption layer convertible by heat into a cohesive self-supporting film of said thermoplastic particles fused together and forming a laminate with said permanent substrate, the laminate detachable at room temperature from said temporary substrate with a separation force of from 0.5 N/50 mm to 8.0 N/50 mm sample width.

10. The recording material of claim 9, wherein the thin coating is partially hydrolyzed polyvinylalcohol, and said plastics film is selected from the group consisting of polyethylene terephthalate, polyvinyl chloride, PMMA, polyimide, polyamide, polycarbonate and polyolefin.

11. The recording material of claim 9, wherein said porous ink absorption layer further comprises at least one of an inorganic pigment, and inorganic filler, an assistant, and an additive.

12. The recording material of claim 9, including a contact adhesive layer arranged on said temporary substrate between said temporary substrate and said permanent substrate, wherein the adhesion of said contact adhesive layer to said temporary substrate is less that the adhesion of said contact adhesive layer to the laminate such that said contact adhesive layer and the laminate are removable from said temporary substrate with a separation force of from 0.1 N/50 mm to 2.0 N/50 mm sample width.

13. The recording material of claim 9, wherein the mean particle size of said fine thermoplastic particles is from 5 $\mu$m to 20 $\mu$m.

14. The recording material of claim 13, wherein said fine thermoplastic particles are porous.

15. The recording material of claim 9, wherein said fine thermoplastic particles comprise at least one of polyethylene, polypropylene, polyester, polyamide, polyurethane, poly(meth)acrylic polymers, polystyrene, polyvinyl chloride, polyvinyl acetate, polyepoxide, and copolymers thereof.

16. The recording material of claim 9, wherein said porous ink absorption layer has a basis weight of from 10 g/m$^2$ to 50 g/m$^2$.

17. The recording material of claim 9, wherein said porous ink absorption layer contains a plasticizer.

18. The recording material of claim 9, wherein said ink absorption layer forms the self-supporting film at from 80° C. to 200° C.

19. A recording material for recording aqueous inks, said recording material comprising:

(i) a temporary substrate, said temporary substrate selected from the group consisting of a) a paper impregnated with silicones, b) a paper coated with silicones, c) a paper impregnated with chromium compounds, d) a paper coated with chromium compounds, e) a plastics film coated with silicones, f) and a paper coated with silicone-free synthetic polymers, said silicone-free synthetic polymers selected from the group consisting of polyethylene, polypropylene, polyesters and copolymers thereof, and cellulose derivatives; and (ii) a porous ink absorption layer arranged on said temporary substrate, said ink absorption layer comprising from 5% to 40% by weight of film-forming binder, and from 60% to 95% by weight of fine thermoplastic particles having a mean particle size of from 0.5 $\mu$m to 40 $\mu$m;

said ink absorption layer convertible by heat into a cohesive self-supporting film of said thermoplastic particles fused together, said self-supporting film detachable at room temperature from said temporary substrate with a separation force of from 0.10 N/50 mm to 2.0 N/50 mm sample width.

20. The recording material of claim 19, wherein the mean particle size of said fine thermoplastic particles is from 5 $\mu$m to 20 $\mu$m.

21. The recording material of claim 20, wherein said fine thermoplastic particles comprise at least one of polyethylene, polypropylene, polyester, polyamide, polyurethane, poly(meth)acrylic polymers, polystyrene, polyvinyl chloride, polyvinyl acetate, polyepoxide and copolymers thereof.

22. The recording material of claim 21, wherein said fine thermoplastic particles are porous.

23. The recording material of claim 19, wherein said porous ink absorption layer has a basis weight of from 10 g/m$^2$ to 50 g/m$^2$.

24. The recording material of claim 19, wherein said porous ink absorption layer contains a plasticizer.

25. The recording material of claim 19, wherein said ink absorption layer forms the self-supporting film at from 80° C. to 200° C.

26. The recording material of claim 19, wherein said porous ink absorption layer further comprises at least one of an inorganic pigment, an inorganic filler, an assistant, and an additive.

* * * * *

UNITED STATES PATENT AND TRADEMARK OFFICE

CERTIFICATE OF CORRECTION

PATENT NO. : 6,177,187 B1
DATED : January 23, 2001
INVENTOR(S) : Axel Niemoller et al.

It is certified that error appears in the above-identified patent and that said Letters Patent is hereby corrected as shown below:

Title page, Item [73],
Change the Assignee from 'Sinhl GmbH" to -- Sihl GmbH --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*